United States Patent [19]

Cowan et al.

[11] Patent Number: 4,634,123

[45] Date of Patent: Jan. 6, 1987

[54] SPRING ACTUATED CUE STICK

[76] Inventors: James H. Cowan; George Spector, both of 233 Broadway RM 3615, New York, N.Y. 10007

[21] Appl. No.: 667,556

[22] Filed: Nov. 2, 1984

[51] Int. Cl.[4] ..... A63D 15/08

[52] U.S. Cl. ..... 273/69; 273/23

[58] Field of Search ..... 273/68, 69, 3 C, 23, 273/24; 124/16, 26, 27

[56] References Cited

U.S. PATENT DOCUMENTS

| | | | |
|---|---|---|---|
| 497,929 | 5/1893 | Shumaker | 273/69 |
| 1,042,299 | 10/1912 | Weidman | 273/69 |
| 1,054,830 | 3/1913 | Crabb | 273/69 |
| 1,182,530 | 5/1916 | Doane | 273/69 |
| 1,604,023 | 10/1926 | Coyle | 273/69 |

FOREIGN PATENT DOCUMENTS

| | | | |
|---|---|---|---|
| 83/00096 | 1/1983 | World Int. Prop. O. | 273/69 |
| 3449 | of 1878 | United Kingdom | 273/23 |

*Primary Examiner*—Richard C. Pinkham
*Assistant Examiner*—Matthew L. Schneider

[57] ABSTRACT

An inner spring device cue stick is provided and consists of a trigger in a handle which will release a spring pressed chalked cue rod within a hollow housing of the cue stick to strike a ball whereby the rod can be set to deliver a stroke at any desired pressure by way of a series of teeth on said rod which engage on inner end of the trigger restraining the rod at a predetermined spring pressure; wherein the front of the housing may be adjusted to varying heights by an adjustable foot which is supported by the playing table.

1 Claim, 7 Drawing Figures

SPRING ACTUATED CUE STICK

BACKGROUND OF THE INVENTION

The instant invention relates generally to pool cues and more specifically it relates to an inner spring drive cue stick for playing pool and billiards.

Numerous pool cues have been provided in prior art that are adapted to spring actuate a shaft to strike against a ball as the game is played. For example, U.S. Pat. Nos. 3,447,805, 3,858,882 and 4,k34,588 all are illustrative of such prior art. While these units may be suitable for the particular purpose to which they address, they would not be as suitable for the purposes of the present invention as heretofore described.

SUMMARY OF THE INVENTION

A principle object of the present invention is to provide an inner spring drive cue stick that has a trigger in a handle which will release a chalked cue rod within a hollow casing of the cue stick to strike a ball whereby the rod can be set to deliver a stroke at any desired pressure thus eliminating unnecessary mis-cues.

Another object is to provide an inner spring drive cue stick that has a positioning adjustment device at the tip so that a person can properly align the cue stick with the ball before the rod strikes the ball.

An additional object is to provide an inner spring drive cue stick which will assist people who are not proficient at the game or have never played before to have fun playing pool.

A further object is to provide an inner spring drive cue stick that is simple and easy to use.

A still further object is to provide an inner spring drive cue stick that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 5:
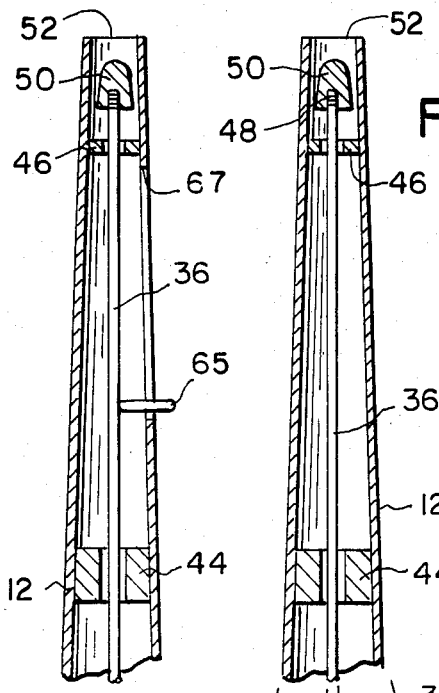
FIG. 5 is a partial vertical cross sectional view of a first modification showing an adjustment post connected directly to the rod.

Turning now descriptively to the drawings, in which similar reference characters denote similar elements throughout the several views, FIGS. 1 through 4 illustrates a cue stick 10 that has an elongated hollow tapered housing 12 of which the rear extremity forms a handle 14. A first plate 16 is provided with a plurality of spaced apart graduations 18 which indicates the varying degrees of pressure that may be applied by cue stick 10 when in use. Plate 16 has an elongated slot 20 which coincides with an elongated slot 22 in the housing 12 when plate 16 is attached thereto. A second plate 24 also has an elongated slot 26 which coincides with an elongated slot 28 opposite slot 22 in the housing 12 when plate 24 is attached thereto.

An outer sleeve 30 provides a sliding adjustment for cue stick 10. An internal sleeve 32 is secured by rivets 34 to the outer sleeve 30. The rivets 34 are are received within slots 20 and 26 of plates 16 and 24 respectively providing a guide therefore. A transverse pin 34 secures sleeve 32 to an elongated rod 36 on the interior of housing 12. A pin 35 secures rod 36 to sleeve 32, whereby movement of sleeve 32 results in movement of rod 36. Rod 36 is slideably received through center of disc 38, disc 40, disc 42, disc 44 and disc 46, all of which are stationary within housing 12. One end 48 of rod 36 is threaded externally and threadingly receives a cue tip 50 which may be chalked in a well known manner. Cue tip 50 remains just within opening 52 at tapered end of the housing 12 until rod 36 is released.

Rod 36 is provided with a plurality of teeth 54 which engages with a trigger latch 56. Trigger latch 56 is springingly urged to engage with teeth 54 of rod 36 by a spring 58 within handle 14 of the housing 12 and is pivoted by a pivot pin 60. Trigger latch 56 has a depressable concave trigger end 62 which will allow the rod 36 to be released. A disc 64 attached to rod 36 is slideable within housing 12. A coil spring 66 within the housing 12 is between disc 64 and disc 40. When outer sleeve 30 is manually pulled downward inner sleeve 32 will push rod 36 and disc 64 downward compressing spring 66 against disc 40. If trigger end 62 is depressed it disengages trigger latch 56 from teeth 54 of rod 36 and thus spring 66 will drive rod 36 and its associated cue tip 50 forward out of opening 52 from within the housing 12 to strike a ball.

It shall be noted that the force of rod 36 is determined by the setting of outer sleeve 30 by the use of graduation 18 on plate 16. When outer sleeve 30 is fully rearward upon cue stick 10 it delivers a maximum amount of force to the cue tip 50. When outer sleeve 30 is positioned towards the first graduation at forward end of the cue stick 10 a minimum amount of force is exerted upon cue tip 50 by spring 66.

FIG. 5 shows a modification whereby a post 64 is transversely connected to the rod 36. The housing 12 has an elongated slot 67 with the post 65 extending therethrough. The post 65 thus substitutes plate 16, plate 24, outer sleeve 30 and inner sleeve 32. The graduations 18 can be placed adjacent the slot 66 making the setting of the rod 36 much easier.

Figure 6:
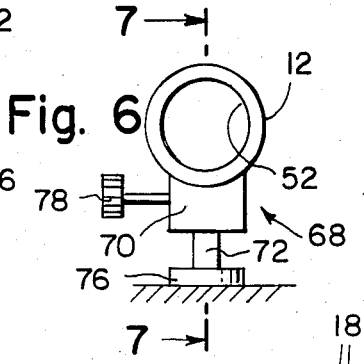
FIG. 6 is a front view of a second modification showing a tip elevational adjustment device.
Figure 7:
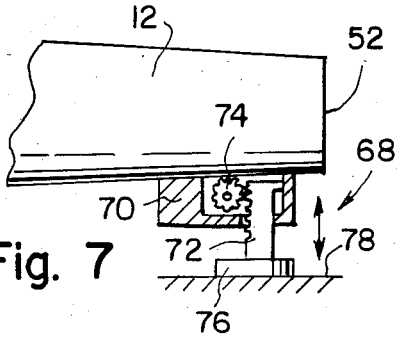
FIG. 7 is a cross sectional view taken along line 7—7 in FIG. 6.
Figure 2:
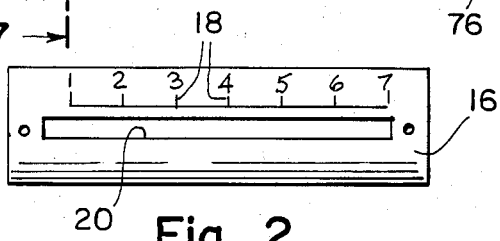
FIG. 2 is a plan view of one plate removed from the housing.
Figure 3:
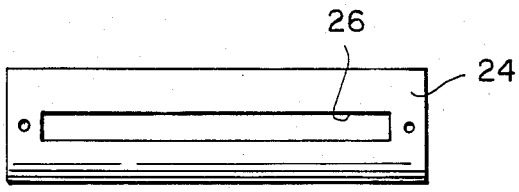
FIG. 3 is a plan view of another plate removed from the housing.
Figure 4:
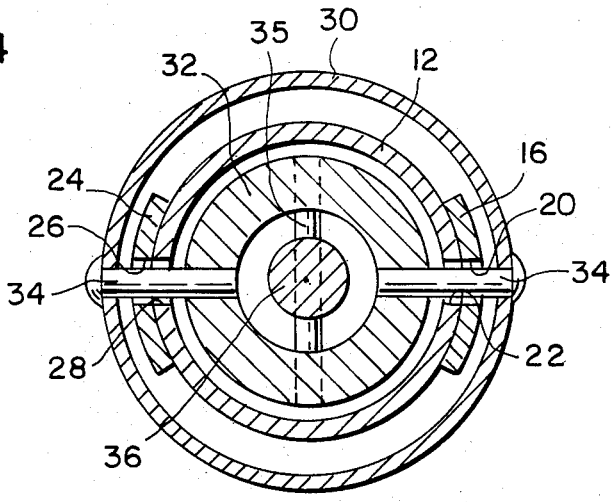
FIG. 4 is a horizontal cross sectional view taken along line 4—4 in FIG. 1.
Figure 1:
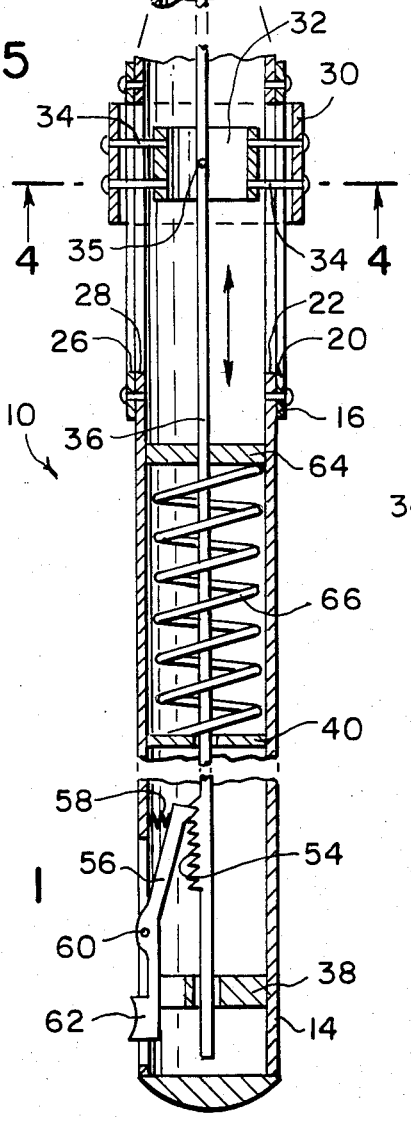
FIG. 1 is a vertical cross section with parts broken away of the invention.

FIGS. 6 and 7 show a tip elevational adjustment device 68 adjacent the opening 52 of the housing 12. A case 70 is attached to the housing 12. Within the case 70 is a rack 72 and meshing pinion gear 74. A foot 76 is attached to bottom of the rack 72 while an adjustment knob 78 is attached to center of the pinion gear 74. When the knob 78 is turned the rack 72 will move up or down thus adjusting the tip of the housing 12 with respect to playing surface 7 of a pool table.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An inner spring drive cut stick which comprises:

(a) a hollow tapered housing, having a front and rear;

(b) a moveable elongated rod within said housing, having front and rear ends;

(c) means for propelling said rod forward within said housing;

(d) means for adjusting said rod rearward for propulsion;

(e) a trigger means for holding and releasing said rod responsive to manual actuation;

(f) a tapered cue tip secured to said front of said rod moveable from within said housing through said housing front to a position outward of said housing;

(g) a plurality of spaced apart stationary discs mounted within said housing for guiding said rod therethrough, one said stationary disc is secured near said front of said housing to positively and accurately guide said cue tip outwardly from said housing, wherein said means for propelling comprises:

(h) a disc secured to said rod and slideable within said housing; and (i) a coil compression spring which is received around said rod within said housing, one end of said coil spring being in abuttment with said slideable disc while the other end of said coil spring is in abutment with one of said stationary discs, wherein said trigger means comprises:

(j) said rod having a plurality of teeth at said rear end;

(k) a trigger latch springly urged to engage with one of said teeth of said rod, said trigger latch having a concave trigger end which will allow said rod to be released when said trigger end is depressed, wherein said means for adjusting said rod for propulsion comprises:

(1) an internal sleeve slideably mounted in said housing and secured to said rod;

(m) said housing having a pair of opposing longitudinal slots;

(n) a pair of spacer plates, each said plate having an elongated slot which coincides with one of said slots in said housing when said plate is attached thereto, one of said plates having a plurality of spaced apart graduations which indicates varying degrees of pressure of said spring;

(o) an outer sleeve secured to said inner sleeve through said slots in said plates and said housing for manually actuating said inner sleeve and rod to said rearward position thereby compressing said spring and causing said trigger latch to engage one of said teeth to hold said rod in a rearward position, said plates spacing said outer sleeve from said housing thereby reducing sliding friction and providing improved means for grasping said outer sleeve said cue stick includes a housing front elevational adjustment device which comprises:

(p) a case attached adjacent said housing front;

(q) a rack slideably mounted within said case;

(r) a pinion gear within said case meshing with said rack;

(s) a foot attached to bottom of said rack and (t) an adjustment knob attached to the center of said pinion gear so that when said knob is turned said rack with said foot will move up and down thus adjusting said front of said housing with respect to a playing surface of a pool table.

* * * * *